US006250185B1

(12) United States Patent
Tsung

(10) Patent No.: US 6,250,185 B1
(45) Date of Patent: Jun. 26, 2001

(54) SCREWDRIVER

(76) Inventor: Kuo-Hua Tsung, P.O. Box 453, Taichung (TW)

( * ) Notice: Subject to any disclaimer, the term of this patent is extended or adjusted under 35 U.S.C. 154(b) by 0 days.

(21) Appl. No.: 09/632,653

(22) Filed: Aug. 4, 2000

(51) Int. Cl.[7] ..... B25B 23/00

(52) U.S. Cl. ..... 81/439; 81/177.4

(58) Field of Search ..... 81/439, 438, 177.4, 81/177.1, 489

(56) References Cited

U.S. PATENT DOCUMENTS 4,848,197 * 7/1989 Kikel ..... 81/439

* cited by examiner

*Primary Examiner*—D. S. Meislin

(57) ABSTRACT

A screwdriver comprises a handle, a shank, and two tip rods. The handle is provided with a longitudinal hole and an inclined oval hole in communication with the longitudinal hole. The inclined oval hole is provided with a see-through window. The two tip rods are fastened with both ends of the shank. The shank is located in the longitudinal hole of the handle such that the tip fastened at the lower end of the shank is visible to the naked eye via the see-through window of the handle.

2 Claims, 4 Drawing Sheets

SCREWDRIVER

BACKGROUND OF THE INVENTION

1. Field of the Invention

The present invention relates to an improved screwdriver.

2. Description of Related Art

The conventional screwdrivers are generally provided with two or more tips of various forms, which are fastened with both ends of the shank of the screwdrivers. The tip which is fastened with the inner end of the shank is kept in the hollow interior of the handle of the screwdrivers. As a result, one can not tell the form of the tip which is fastened with the inner end of the shank of the screwdriver.

BRIEF SUMMARY OF THE INVENTION

The primary objective of the present invention is to provide a screwdriver with a handle having a see-through window through which one can tell the form of a tip which is fastened to the inner end of the screwdriver shank.

The objective, features and the advantages of the present invention will be more readily understood upon a thoughtful deliberation of a preferred embodiment of the present invention with reference to the accompanying drawings.

DETAILED DESCRIPTION OF THE INVENTION

Figure 1:
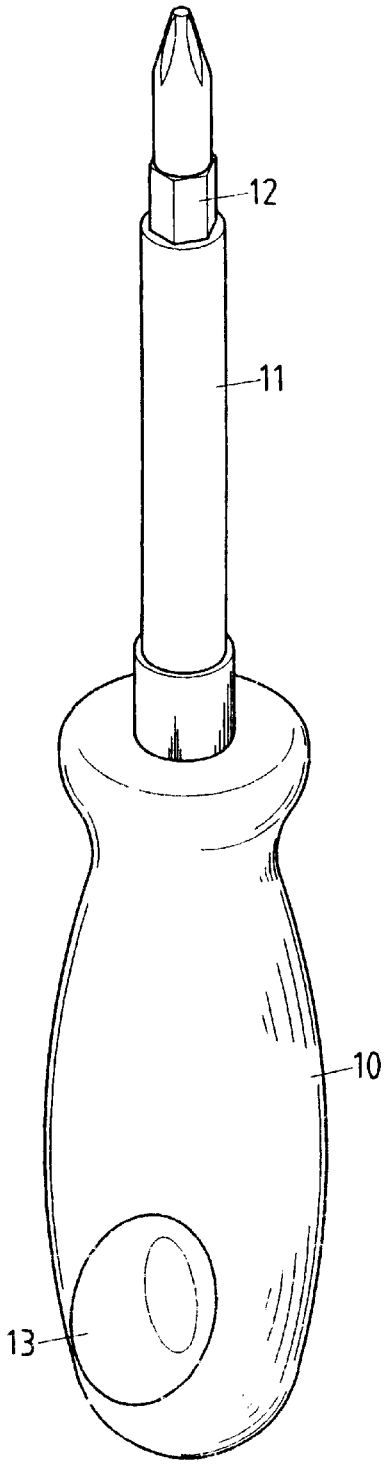
FIG. 1 shows a schematic view of the preferred embodiment of the present invention.
Figure 2:
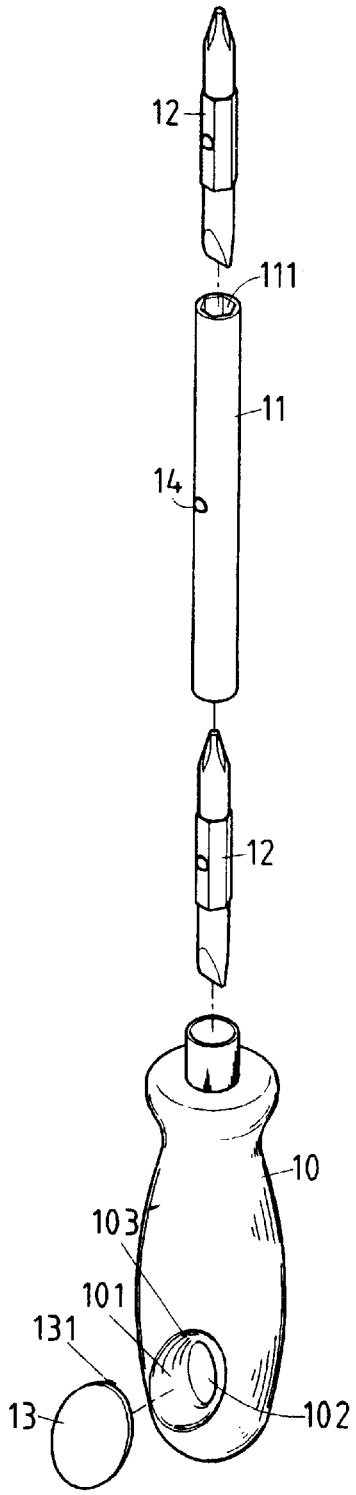
FIG. 2 shows an exploded view of the preferred embodiment of the present invention.
Figure 3:
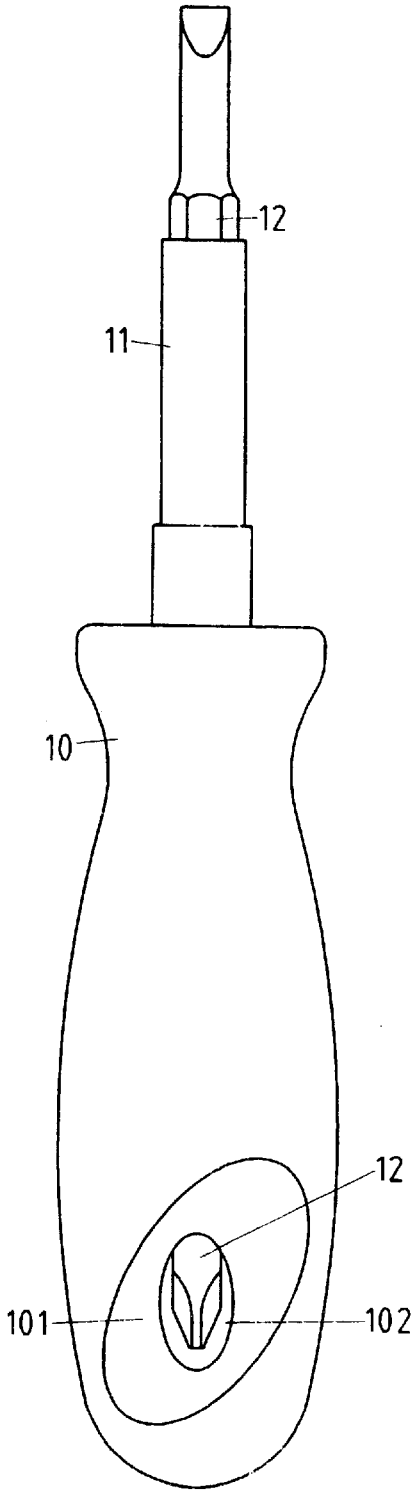
FIG. 3 shows a perspective view of the preferred embodiment of the present invention.
Figure 4:
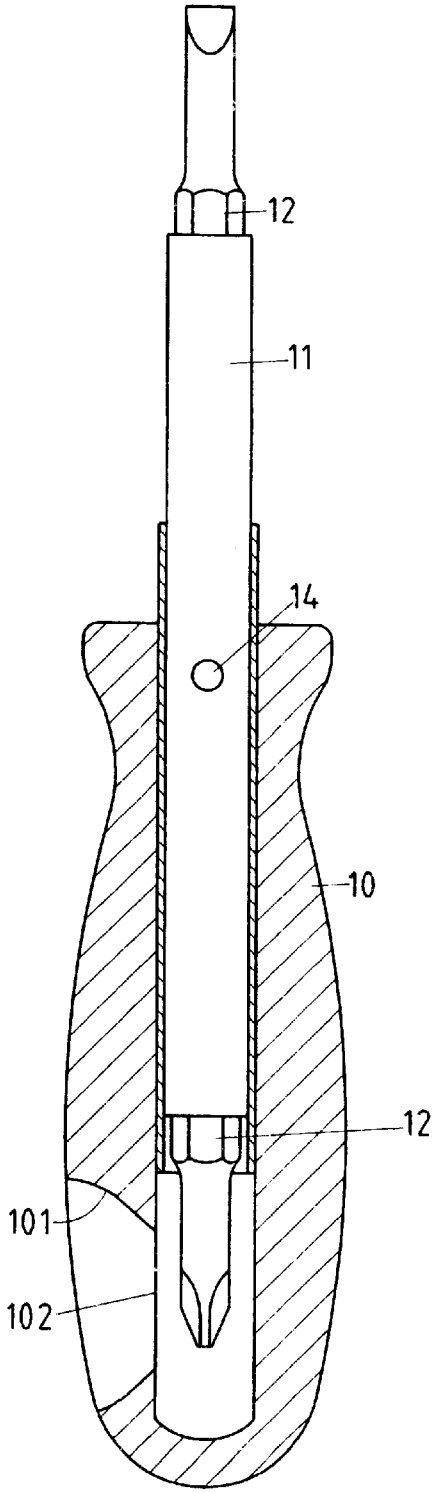
FIG. 4 shows a longitudinal sectional view of the preferred embodiment of the present invention.

As shown in all drawings provided herewith, a screwdriver embodied in the present invention comprises a handle 10, a shank 11, and two tip rods 12.

The handle 10 is provided in the interior with a longitudinal hole 102, and in proximity of the bottom end thereof with an inclined oval hole 101 in communication with the longitudinal hole 102. The inclined oval hole 101 is provided in the inner wall with a plurality of retaining blind holes 103. The inclined oval hole 101 is further provided with a transparent cover 13 which is in turn provided with a plurality of retaining projections 131. The cover 13 is located in the inclined oval hole 101 such that the retaining projections 131 are received in the retaining blind holes 103 of the inclined oval hole 101.

The shank 11 is provided in both longitudinal ends with a fitting hole 111, and in the outer wall thereof with a locating member 14 which is formed of a spring (not shown in the drawings) and a steel ball (not shown in the drawings). The locating member 14 is retained by a locating device (not shown in the drawings) of the inner wall of the longitudinal hole 102 of the handle 10.

The two trip rods 12 are provided at both ends with a tip of a specific form, and are securely fitted into the fitting holes 111 of the shank 11. One can tell the form of the tip which is fastened with the lower end of the shank 11 via the cover 13.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. A screwdriver comprising:

a handle provided in an interior with a longitudinal hole of a predetermined depth, and in proximity of a bottom end thereof with an inclined oval hole in communication with said longitudinal hole, said inclined oval hole being provided with a transparent cover, said longitudinal hole being provided in an inner wall thereof with a locating device;

a shank provided in both longitudinal ends with a fitting hole, and in an outer wall with a locating member formed of a spring and a steel ball, whereby said shank is received in said longitudinal hole of said handle such that said locating member of said shank is retained by said locating device of said longitudinal hole of said handle; and two tip rods provided at both ends with a tip of a specific form and fitted securely into said fitting holes of said shank such that a tip fastened with a lower end of said shank is corresponding in location to said cover of said inclined oval hole of said handle.

2. The screwdriver as defined in claim 1, wherein said inclined oval hole is provided in an inner wall with a plurality of retaining blind holes; wherein said cover is provided with a plurality of retaining projections and is located in said inclined oval hole such that said retaining projections of said cover are received in said retaining blind holes of said inclined oval hole.

* * * * *